US010161710B2

(12) United States Patent
Rivera

(10) Patent No.: US 10,161,710 B2
(45) Date of Patent: Dec. 25, 2018

(54) WEAPONS EMBEDDED IN A WEARABLE ITEM

(71) Applicant: John V. Rivera, Melbourne, FL (US)

(72) Inventor: John V. Rivera, Melbourne, FL (US)

( * ) Notice: Subject to any disclaimer, the term of this patent is extended or adjusted under 35 U.S.C. 154(b) by 0 days.

(21) Appl. No.: 15/434,366

(22) Filed: Feb. 16, 2017

(65) Prior Publication Data

US 2017/0241736 A1 Aug. 24, 2017

Related U.S. Application Data

(60) Provisional application No. 62/296,683, filed on Feb. 18, 2016.

(51) Int. Cl.

| | |
|---|---|
| ***F41C 9/02*** | (2006.01) |
| ***F41C 27/16*** | (2006.01) |
| ***F41G 1/35*** | (2006.01) |
| ***F41A 19/39*** | (2006.01) |

(52) U.S. Cl.

CPC ..... *F41C 9/02* (2013.01); *F41A 19/39* (2013.01); *F41C 27/16* (2013.01); *F41G 1/35* (2013.01)

(58) Field of Classification Search

CPC ..... F41H 9/10; F41C 9/00; F41C 9/02; F41C 27/16; F41G 1/35; F41A 19/39

USPC ..... 42/1.09, 1.11, 1.13, 1.16, 52, 53

See application file for complete search history.

(56) References Cited

U.S. PATENT DOCUMENTS

| | | | | |
|---|---|---|---|---|
| 1,073,312 | A * | 9/1913 | Woods | F41C 9/02 42/1.09 |
| 1,663,834 | A * | 3/1928 | Goss | F41H 9/10 42/1.08 |
| 3,018,578 | A * | 1/1962 | Hill | F41C 9/02 42/1.11 |
| 3,084,466 | A * | 4/1963 | Duncan, III | F41H 9/10 42/1.08 |
| 4,083,138 | A * | 4/1978 | Cash | F41C 3/00 102/501 |
| 4,260,087 | A * | 4/1981 | Leaver | A44B 11/005 224/163 |
| 4,313,230 | A | 2/1982 | Chovaniec | |
| 4,377,249 | A | 3/1983 | Bockoven | |
| 4,748,759 | A * | 6/1988 | Whiteing | F41C 9/00 42/1.09 |
| 4,836,425 | A * | 6/1989 | McClellan | F41C 33/0209 224/163 |
| 5,217,150 | A | 6/1993 | Chen | |
| 5,782,025 | A * | 7/1998 | Yoder | F41C 9/02 42/1.09 |
| 6,778,811 | B1 * | 8/2004 | Grove | F41A 17/04 224/539 |
| 7,905,042 | B2 * | 3/2011 | Carmel | F41A 19/10 42/1.09 |

(Continued)

*Primary Examiner* — John Cooper

(74) *Attorney, Agent, or Firm* — John L. DeAngelis; Beusse Wolter Sanks & Maire PLLC

(57) ABSTRACT

This invention is characterized by its appearance as a bracelet or a wrist watch, for example. The distinctive features of this device are its micro size, stealth-ness, and light weight. The object of this invention is to a provide state-of-the-art personal protection in two forms, a firearm and a knife, both of which are totally concealable even if the wearer is not wearing clothes. They are both instantly available and easily deployed to protect oneself from an imminent threat.

12 Claims, 18 Drawing Sheets

(56) References Cited

U.S. PATENT DOCUMENTS

| | | | | |
|---|---|---|---|---|
| 9,958,226 | B2 * | 5/2018 | Merritt | F41G 11/004 |
| 2010/0000137 | A1 * | 1/2010 | Carmel | F41A 19/10 42/1.05 |

* cited by examiner

9MM CALIBER
HOLLOW POINT

25 CALIBER
HOLLOW POINT

RECTANGLE

22 CALIBER
SHORT

SQUARE

WEAPONS EMBEDDED IN A WEARABLE ITEM

CROSS REFERENCE TO RELATED APPLICATIONS

This patent application claims the benefit of U.S. provisional patent application filed on Feb. 18, 2016 and assigned Application No. 62/296,683, which is incorporated herein in its entirety.

BACKGROUND OF THE INVENTION

In today's society, attacks by weapon-carrying perpetrators against individuals are not uncommon. Moreover, sexual assaults by males against often physically weaker females are unfortunately commonplace. One need only read the latest news stories or watch a broadcast news show. In addition to the increase in attacks against individuals, terroristic actions against gathered groups of people, such as at sporting or entertainment events, nightclubs, and movie theaters have increased. As well, armed robberies of convenience stores and similar establishments continue to be problematic. Further, individuals engaging in various athletic or sporting activities may not be wearing apparel that is suitable for concealing a weapon, for example, jogging or bicycle shorts and a T-shirt; or, the activity in which they are engaged may prevent their easy access to a weapon, for example, mountain climbing or bicycling. Today we all tend to be at least a little anxious that we may be the next victim of an assault in one form or another.

According to certain experts in the law enforcement field, the increased level of specific acts of violence may be effectively thwarted, deterred or discouraged by carrying and using, if needed, a concealed weapon against the attacker. One's level of anxiety may be reduced and consequently, their enjoyment of life enhanced by carrying a device for use in defending one's person in the event of an attack by another or others.

There are many circumstances where it is desirable or necessary for a person to carry an article in complete concealment on his or her person. Articles such as passports, money, jewelry, or other valuables may be carried in concealment by a person, because concealed items are more likely to be untouched if a conventional carrying device such as a purse or wallet is stolen. Handguns are often carried in concealment by law enforcement officers and others who are authorized or licensed to do so, and it is often desirable to carry "concealed" weapons in complete concealment on the wearer's body. The concept of complete concealment, in the context of concealed weapons, means that the weapon will continue to not be visible to a casual observer even when the wearer removes an article of clothing, such as a coat or other outer garment Most states have concealed weapon laws that prohibit the carrying of a weapon that is concealed or otherwise disguised from public view without a concealed weapon permit. However, even when lawful to carry a concealed weapon, under a garment or in a bag, for example, the user/wearer will likely find it cumbersome and time consuming to gain quick access to a defensive weapon, remove the weapon from its carry-location, and be in a position to commence using it to defend oneself from an attacker. Additionally, the user/wearer must ensure that he/she has carefully withdrawn the weapon from its concealed location and properly gripped it. The weapon must also be properly stowed to insure against an accidental firing.

BRIEF DESCRIPTION OF THE FIGURES

The skilled artisan will understand that the drawings, as described below, are for illustration purposes only. The drawings are not intended to limit the scope of the present invention in any way. Several of the Figures are block diagrams that depict the components necessary for the operation of the invention.

DETAILED DESCRIPTION OF THE INVENTION

Before describing in detail the particular methods and apparatuses related to a weapon embedded in a wearable item, it should be observed that the present invention resides primarily in a novel and non-obvious combination of elements and process steps. So as not to obscure the disclosure with details that will be readily apparent to those skilled in the art, certain conventional elements and steps have been presented with lesser detail, while the drawings and the specification describe in greater detail other elements and steps pertinent to understanding the inventions.

The presented embodiments are not intended to define limits as to the structures, elements or methods of the inventions, but only to provide exemplary constructions. The embodiments are permissive rather than mandatory and illustrative rather than exhaustive.

The present invention overcomes the disadvantages described above by both making the weapon readily and easily useable for defense against an attacker, and concealing the weapon in a wearable item, worn on the person, including both men and women; while, at the same time, "softening," the otherwise utilitarian appearance of a firearm by adding a fashion element or enhancement, or jewelry application. As used herein the term "weapon" refers to a firearm or a blade or any other instrument or device intended to be used by a person in an attack or for defensive purposes.

In one embodiment, the wearable item comprises a jewelry item a bracelet or wrist watch, for example. When concealed in the bracelet or wrist watch the weapon is not discernable until a lid or top cover is opened or lifted from its resting place, or a pin is activated, thereby making the weapon immediately ready for defensive action against an attacker.

Both men and women may have occasion or proclivity to wear an item of jewelry or other ornamental-type adornment about their body. According to one embodiment of the present invention, a defensive weapon may be effectively concealed in certain items of jewelry and/or bracelets and be immediately ready for defensive action against an attacker.

Thus, the present invention relates generally to an article, a jewelry or fashion item or decorative wristband, for example, carried by or on the person with a defensive device, e.g., a bullet discharging device and or knife embedded therein. According to one embodiment, the defensive device is concealed within the article and cannot be visualized until a lid, cover or top-like component is removed or lifted from its resting place or a pin is activated.

Figure 1:
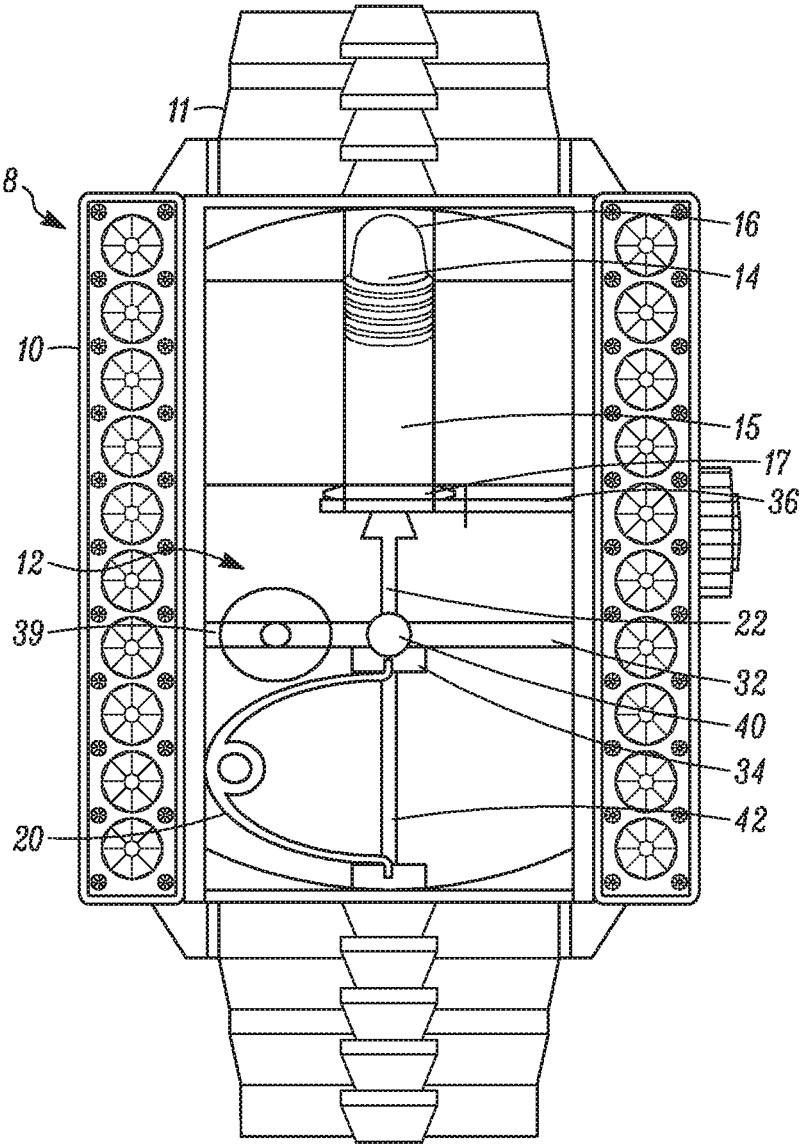
FIG. 1 illustrates a cut-away top view of a bracelet-encased firearm device constructed according to the teachings of the present invention.

FIG. 1 illustrates a cut-away top view of a bracelet-encased firearm device ("the device") 8 comprising an ornamental item 10 and bracelet or wristband 11. A firearm device 12 is embedded and concealed within the ornamental item 10 (more generally embedded and concealed within an enclosure). When activated by a user, a bullet 14 is ejected from a barrel 16.

The bullet 14 is encased within a shell 15. A rear surface 17 of the shell 15 comprises a charge.

Figure 2:
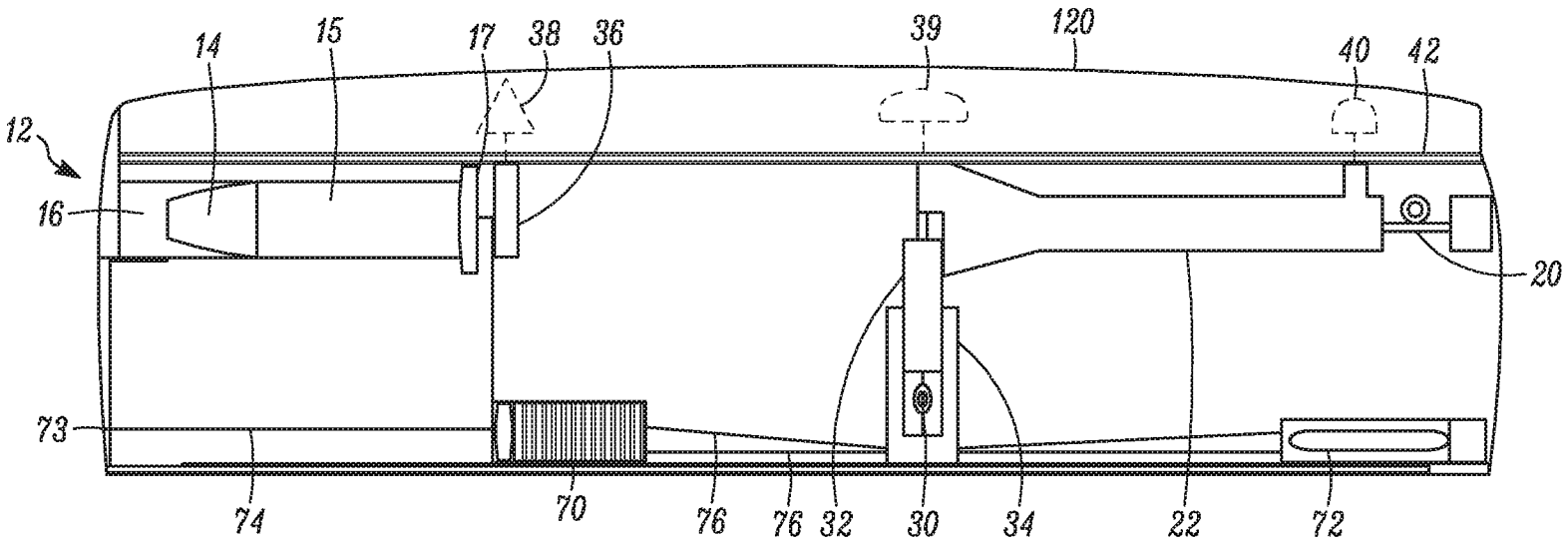
FIG. 2 illustrates a "ready" condition for the firearm of FIG. 1.

A side view of FIG. 2 illustrates a "ready" condition for the firearm 12. A coil 20 (or a spring-like component) is shown in a biased or cocked condition, applying a force to a rear surface of a firing pin 22.

A spring or coil 30 urges a firing pin lock 32 upwardly within a U-shaped support 34 to retain the firing pin 22 in the "ready" configuration against the force exerted on it by the coil 20.

To fire the weapon, first a primer safety component 36 is displaced from contact with a rear surface 17 of the shell 15 by applying a force against a primer safety handle 38 to move the handle and thus the primer safety toward an edge of the weapon 12. This action exposes the rear surface 17 of the shell 15.

Depressing a trigger 39 lowers the firing pin lock 32 within the support 34, releasing the coil 20 from its biased condition, driving the firing pin 22 forward to strike the rear surface 17 of the shell 15 to eject the bullet 14 from the barrel 16.

To place the weapon 12 in a firing-ready condition a firing pin slider 40 is moved within a groove 42 in a direction away from the barrel 16. This action biases the coil 20 and causes the spring 30 to force the firing pin lock 32 upwardly. As best illustrated in FIG. 2, the firing pin lock 32 prevents the firing pin 22 from moving forward until the trigger 39 is depressed.

Returning to the top view of FIG. 1, certain components of the weapon 12, as discussed in conjunction with FIG. 2 are illustrated. All of the components are conveniently compact to fit within the ornamental item 10. The coil 20 generates sufficient force to drive the firing pin 22 forward to strike the rear surface 17 of the shell 15 to eject the bullet 14 from the barrel 16.

Figure 3:
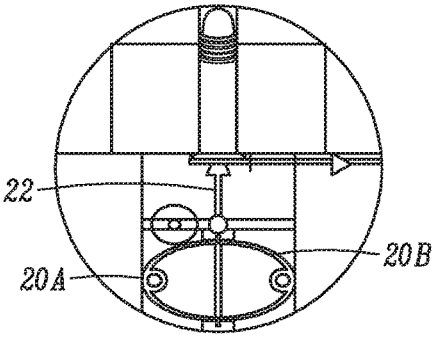
FIG. 3 illustrates a double-coil embodiment of a weapon or firearm constructed according to the teachings of the present invention.

FIG. 3 illustrates a double-coil embodiment comprising two coils 20A and 20B that exert a greater force on the firing pin 22 than the single-coil embodiment of FIGS. one and two. The force exerted by the two-coil embodiment also tends to be more symmetrical relative to a centerline of the weapon.

Figure 4:
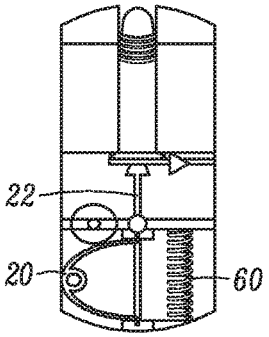
FIG. 4 illustrates an alternative embodiment of a weapon or firearm according to the present invention.

FIG. 4 illustrates an embodiment comprising the coil 20 and a helical spring 60 for exerting a force on the firing pin 22.

Figure 5:
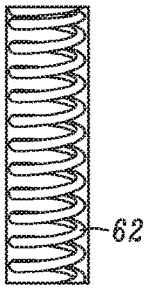
FIGS. 5 and 6 illustrate different embodiments of a helical spring for use in different embodiments of the weapon of the present invention.
Figure 6:
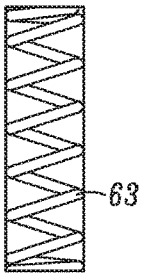
Figure 7:
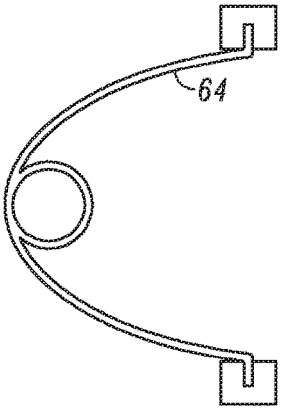
FIGS. 7 and 8 illustrate different embodiments of a coil spring for use in different embodiments of the weapon of the present invention.
Figure 8:
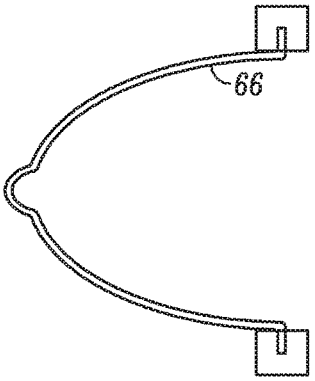

FIGS. 5 and 6 depict different embodiments of a helical spring 62 and 63 for use in the different embodiments of the weapon of the present invention, should the force exerted by the coils 64 and 66, depicted in FIGS. 7 and 8, respectively, need to be increased or augmented to eject the bullet.

FIGS. 7 and 8 depict different embodiments of a coil 64 and 66 for use in the weapon of the present invention as illustrated in FIGS. 1 and 2, replacing the coil 20.

Returning to FIG. 2, a laser 70, powered by a battery 72, emits a laser beam 73 through an opening 74 in the body of the ornamental item 10 as depicted in FIG. 1.

Figure 11:
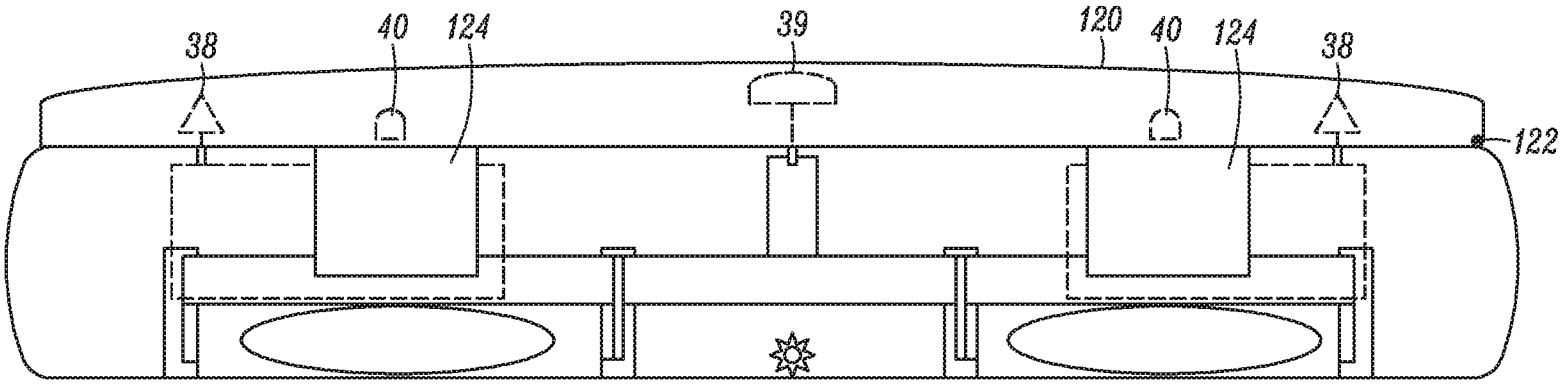
FIGS. 11 and 12 illustrates a safety cover, in closed and open positions, for use with a firearm of the present invention.
Figure 12:
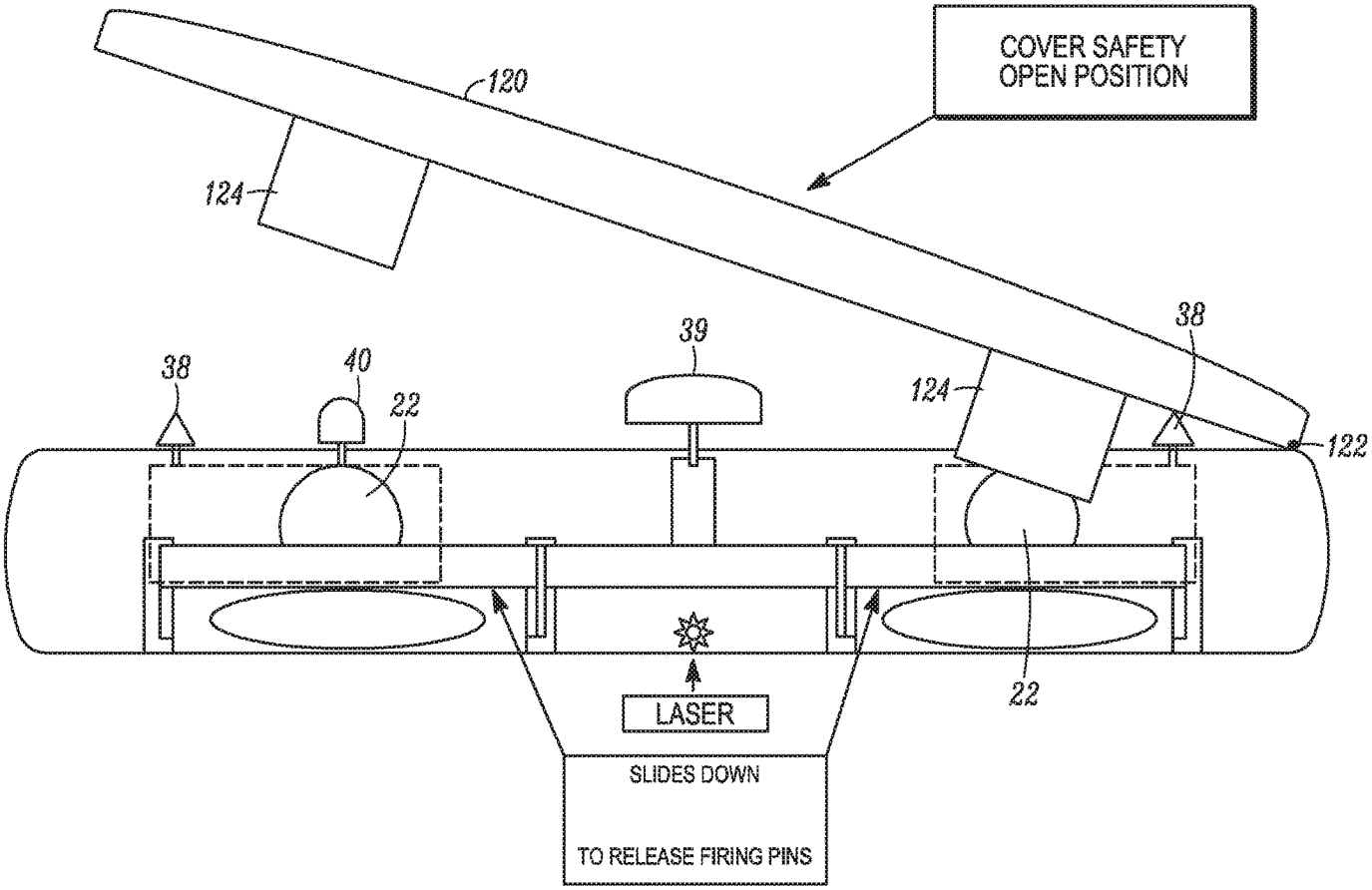

Use of the laser beam provides more accurate aiming at a target for the user. Conductors 76 supply power from the battery 72 to the laser 70. In one embodiment, the laser turns on when the user opens the safety cover 120 as depicted in FIGS. 11 and 12. In another embodiment the laser turns on when the user depresses a laser on-off manual activator 153, as depicted in FIG. 10A.

Figure 9:
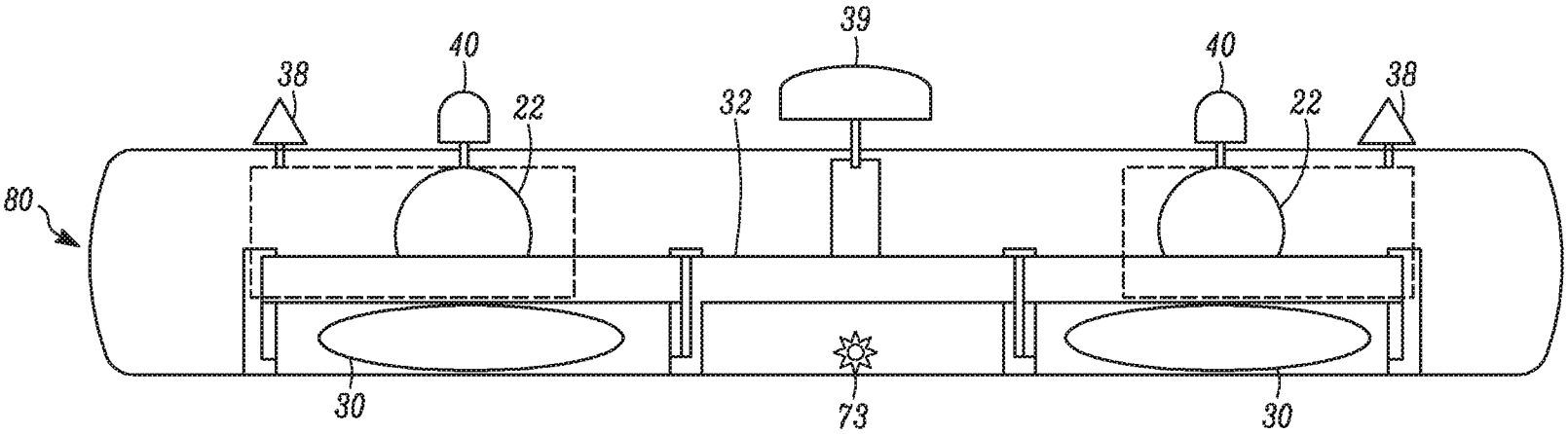
FIG. 9 illustrates a front view of a dual barreled weapon.

FIG. 9 illustrates a front view of a dual barreled weapon version 80 comprising coils 30, primer safeties 38, firing pins 22, etc. as described elsewhere herein. A common firing pin lock 32 and common trigger 39 are also illustrated. Since each barrel in FIG. 9 includes a primer safety 38, a bullet from each barrel can be fired simultaneously (by removing both primer safeties) or individually (by removing only one primer safety).

Figure 10A:
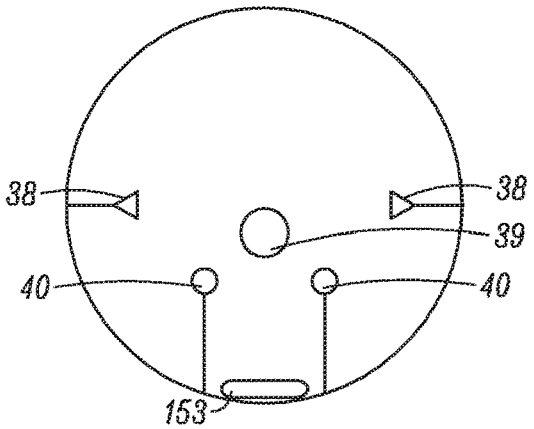
FIGS. 10A, 10B, and 10C, illustrate respective top, cut-away, and bottom views of the dual barreled weapon of FIG. 9.
Figure 10B:
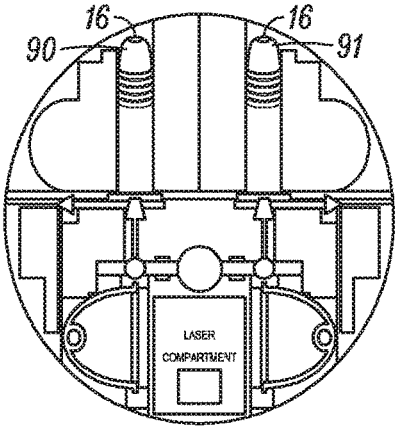
Figure 10C:
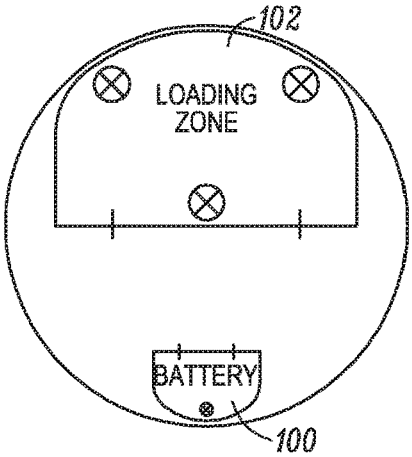

FIGS. 10A, 10B and 10C, illustrate respective top, cut-away, and bottom views of the dual barreled weapon of FIG. 9.

FIG. 10A illustrates the primer safeties 38, the firing pin sliders 40 and the common trigger 39, as well as lines indicating the travel direction for each, and the laser on-off manual activator 153.

FIG. 10B illustrates the cut-away top view depicting barrels 90 and 91.

FIG. 10C is a bottom view depicting a battery cover 100 for closing a compartment in which the battery 72 is contained or disposed. A loading zone cover 102, when opened, reveals the barrels 90 and 91 each for receiving a bullet 16.

FIG. 11 illustrates a safety cover 120, connected to the firearm device through a spring-loaded hinge 122, in a closed position. The primer safeties 38 and the common trigger 39 are illustrated in phantom as they are obscured by the safety cover 120. Flaps 124 extending from the safety cover 120 conceal the weapons barrels.

FIG. 12 illustrates the safety cover 120 in an opened position, revealing the firing pin slider 40, as well as the primer safeties 38 and the common trigger 39. The firing pins 22, which are concentric with the barrels 90 and 91, as depicted in FIG. 10B are also illustrated.

Figure 13A:
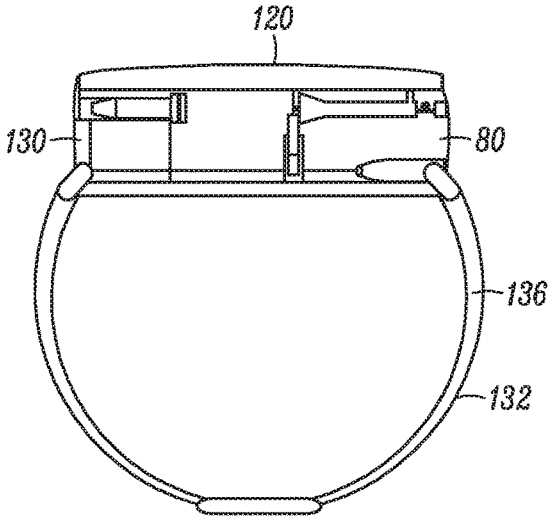
FIGS. 13A and 13B illustrate two views of a dual barrel weapon disposed within an ornamental item.
Figure 13B:
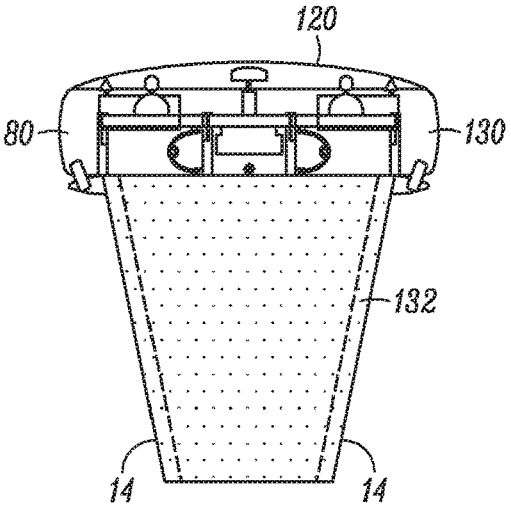

FIGS. 13A and 13B illustrate two views of the dual barrel weapon 80 disposed within an ornamental item 130 attached to a wrist band 132.

Figure 14:
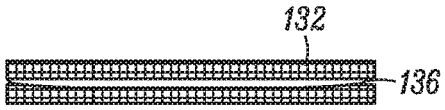
FIG. 14 is a sectional view of a wrist band for use with a weapon of the present invention.

FIG. 14 is a sectional view of the wrist band 132 illustrating a layer of shock-absorbing gel 136 embedded within the wrist band as illustrated. In another embodiment the shock-absorbing gel 136 comprises a liner layer as depicted in FIG. 13A. In either embodiment, the shock-absorbing gel absorbs shock forces that are generated when the weapon is fired and minimizes forces from being transmitted to the arm of the user/wearer.

Figure 15:
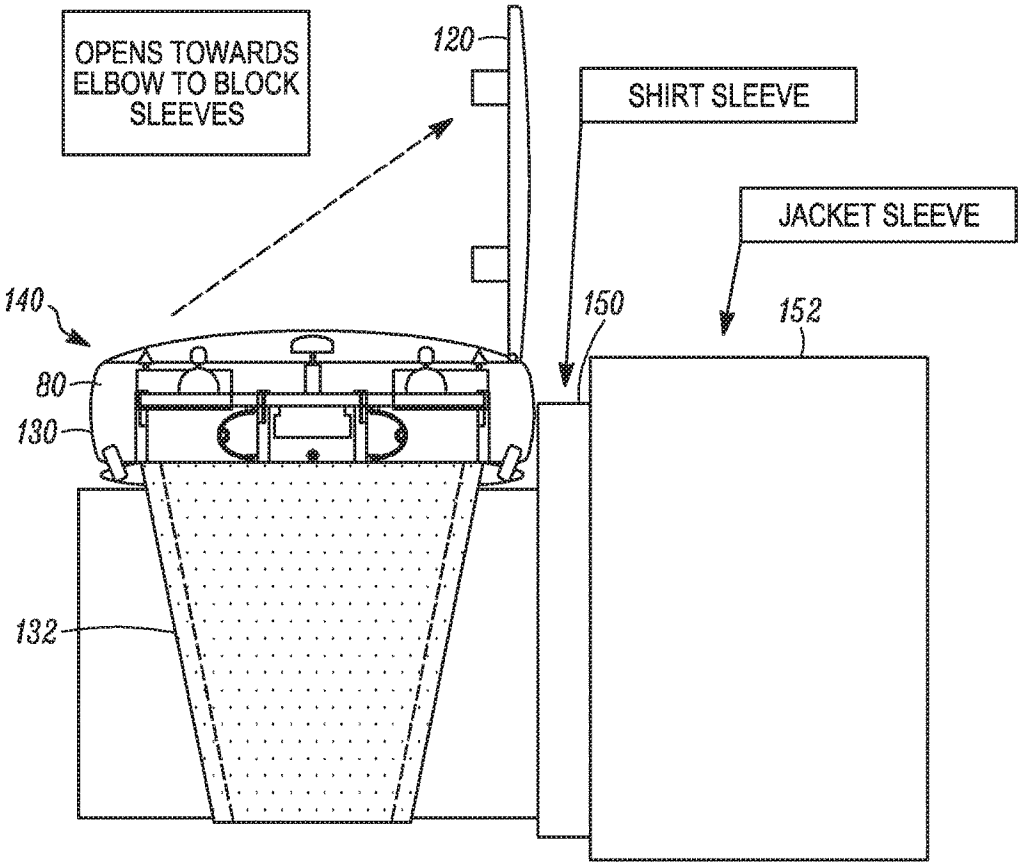
FIG. 15 illustrates a jewelry item in which a firearm according to one of the embodiments of the present invention has been embedded.

FIG. 15 illustrates a jewelry item 140 comprising the dual barrel weapon 80 disposed in the ornamental item 130 attached to the wrist band 132 worn by a user. In particular, FIG. 15 depicts the orientation for the jewelry item 140 relative to a shirt sleeve 150 extending out from a jacket sleeve 152. In particular, the safety cover 120 opens in a direction toward the shirt sleeve 150 and jacket sleeve 152. When fired, the bullets exit the dual barrel weapon 80 in a direction substantially perpendicular to the wearer's arm.

Figure 16:
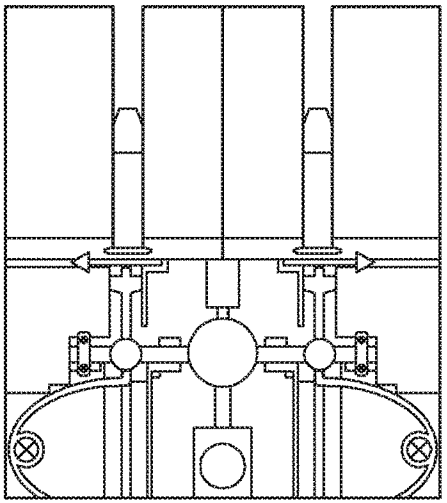

FIG. 16 illustrates a relatively square-shaped embodiment of the present invention for firing 22 caliber short rounds.

Figure 18:
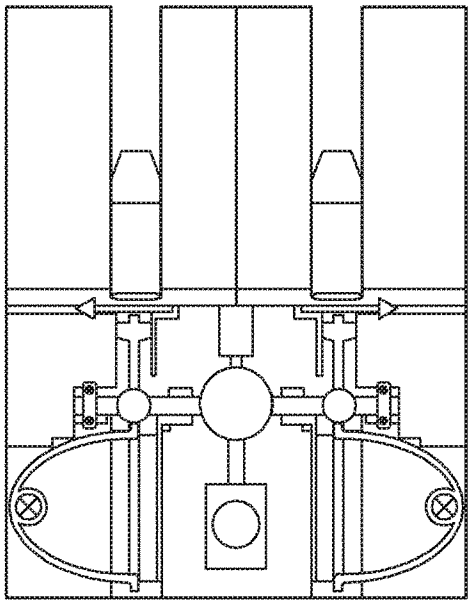
FIGS. 16, 17 and 18 illustrate embodiments of the present invention for firing different sized rounds.
Figure 17:
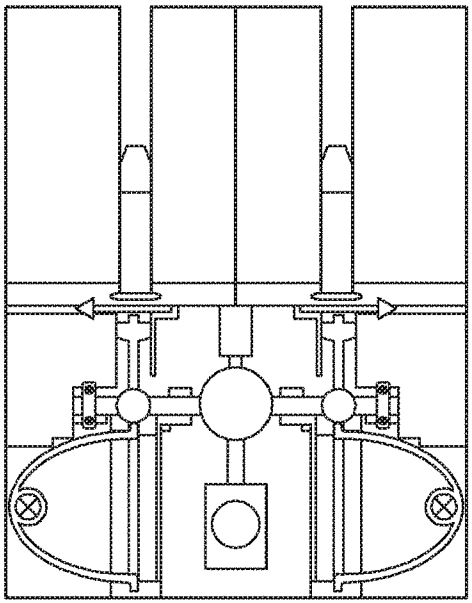

FIGS. 17 and 18 illustrate rectangular-shaped embodiments for firing, respectively 25 caliber hollow point bullet and a 9 mm caliber hollow point bullet.

Figure 19:
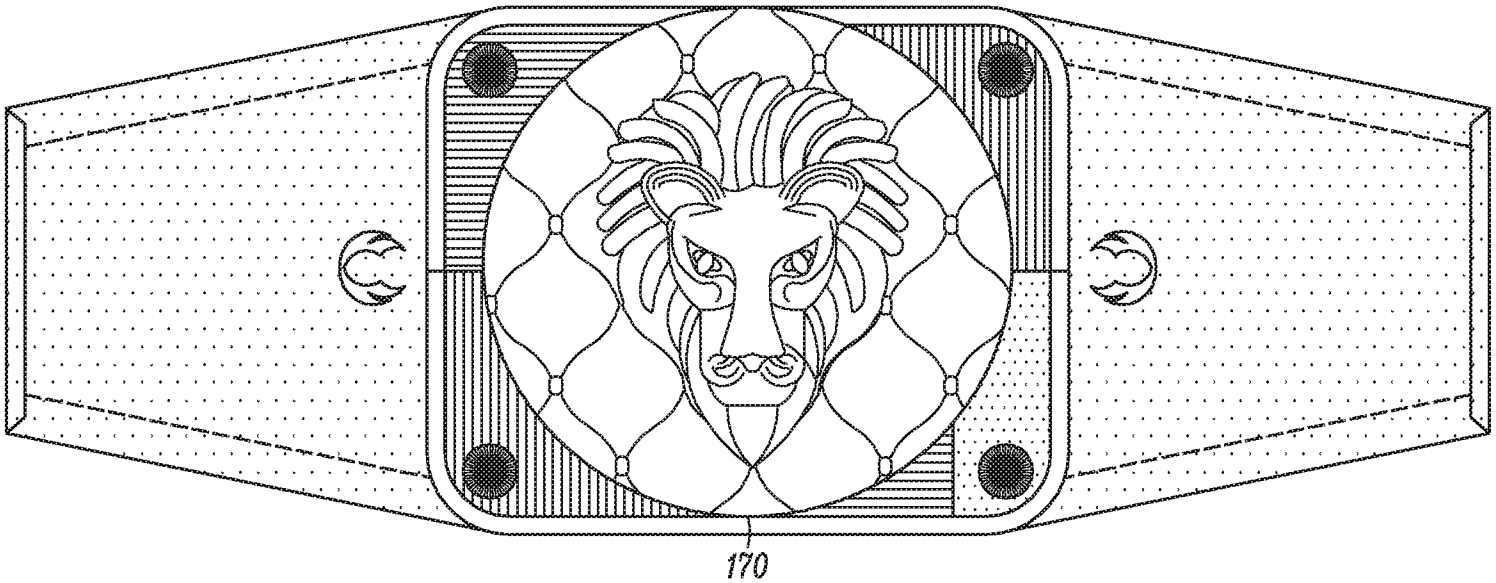
FIG. 19 illustrates an insignia disposed on a decorative cover of a jewelry item for carrying a weapon of the present invention.

FIG. 19 illustrates one design insignia disposed on a decorative cover 170 which serves as the safety cover 120, as shown in FIG. 15, for example. As those skilled in the jewelry design art are aware, there exist many different insignias, types of metal, jewels, etc. that can be used as a design element for the decorative cover 170 of the invention.

Figure 20:
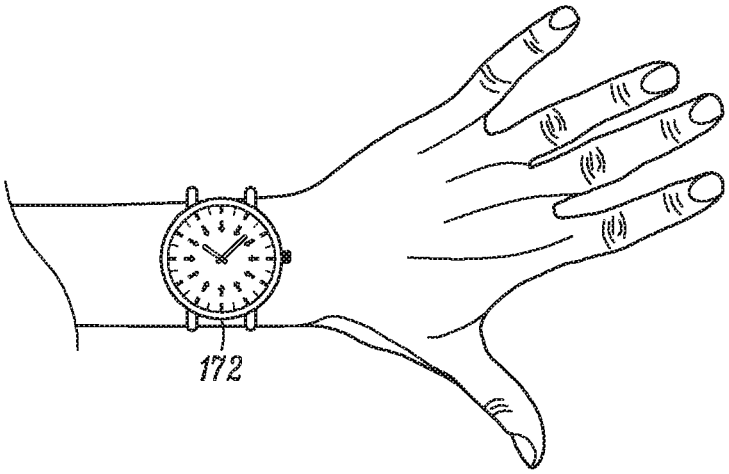
FIGS. 20 and 21 illustrate a wrist-worn time piece carrying a firearm according to the teachings of the present invention.
Figure 21:
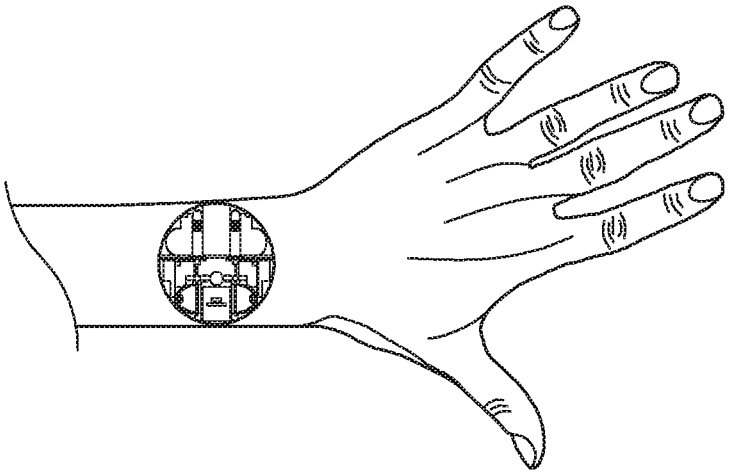

In FIG. 20 a decorative cover 172 comprises a time piece. FIG. 21 is a cut-away view of an ornamental item, according to any of the various embodiments of the invention, showing the firearm components of the weapon.

In the exemplary commercial embodiments illustrated in FIGS. 19 and 20 the visible decorative safety cover conceals the weapon and its components, especially the barrel(s). The safety cover can be adorned on its outer side with different insignias, types of metals, jewels, etc. Located beneath the decorative safety cover are the operational components of the device which are exposed when the decorative safety cover is opened. Opening the safety cover reveals the user controls (e.g., trigger, primer safety and firing pin slider) for operating the weapon.

In a preferred embodiment, the weapon of the present invention further comprises a blade that is concealed within the ornamental item 10 and when activated by the user extends perpendicular outwardly therefrom.

Figure 22:
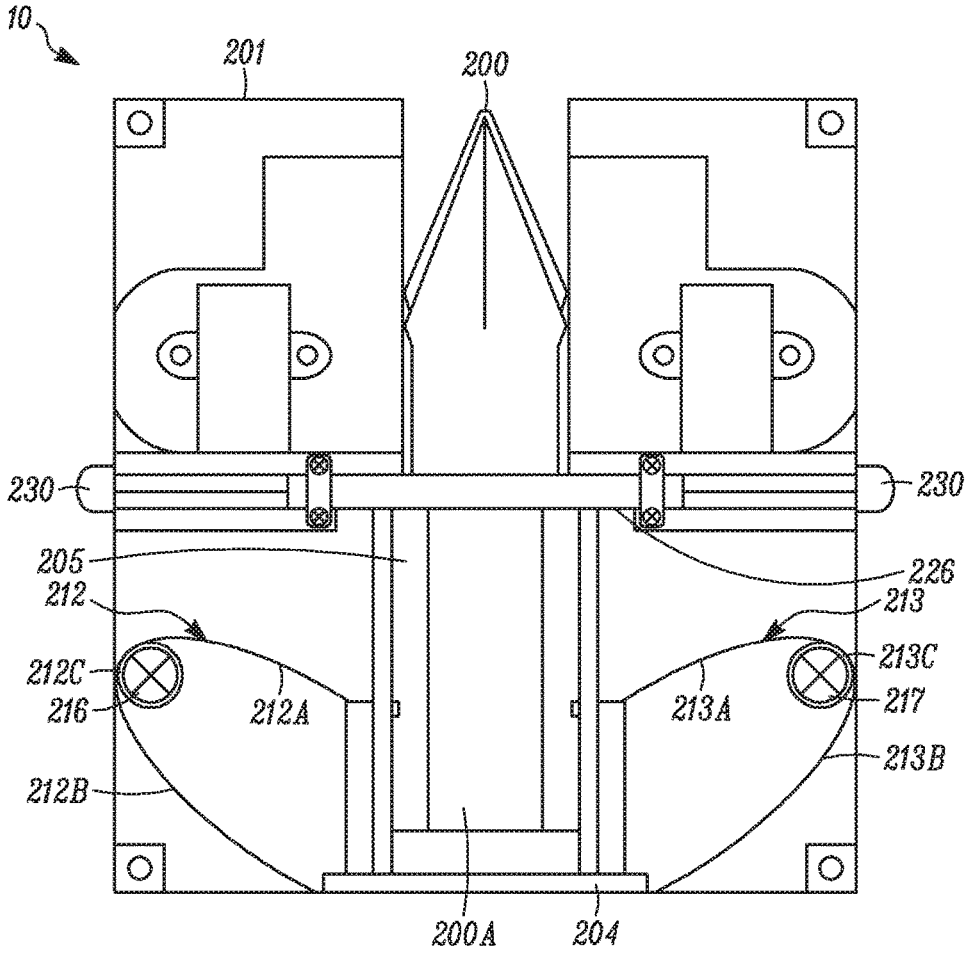
FIGS. 22 and 23 illustrate different views of an embodiment of the present invention comprising both a firearm and a blade embedded in a wearable item.
Figure 23:
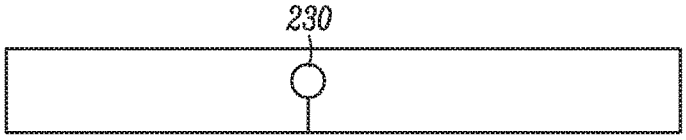

FIG. 22 is a cut-away view of a blade compartment in which the blade and its associated components are located; FIG. 23 is a side view of the blade compartment. FIGS. 22 and 23 depict an embodiment wherein only the blade and associated components are present in an ornamental item, i.e., the firearm is not present.

In FIG. 22 a blade 200 is shown in a retracted position concealed within the blade compartment 201 of the ornamental item 10. A rear end 200A of the blade 200 is supported within a U-shaped support member 204.

Figure 26:
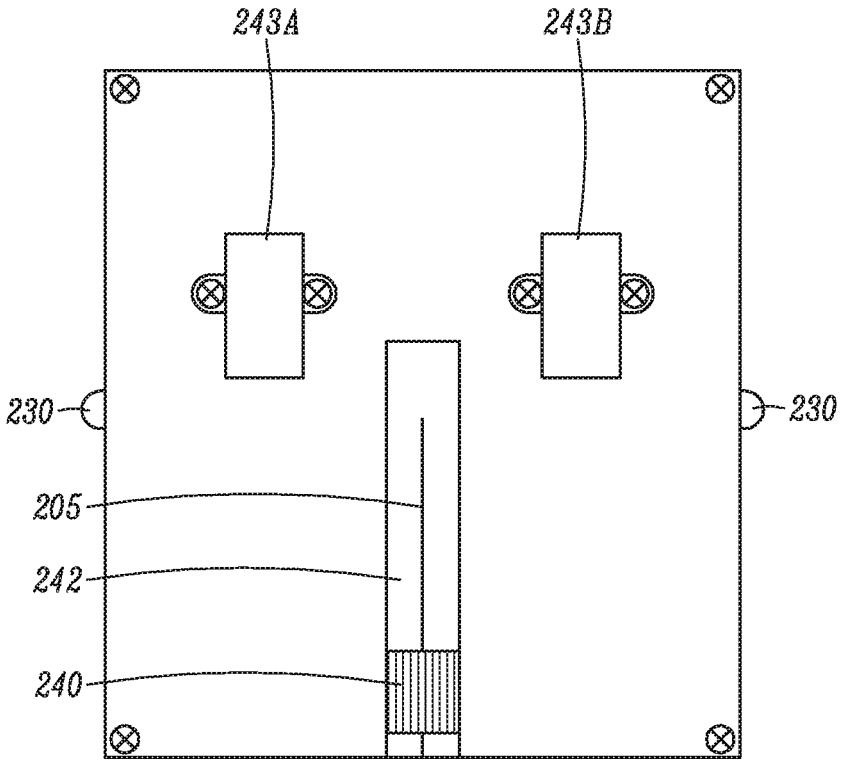
FIGS. 26 and 27 illustrate a bottom view and a rear view of the blade embodiment.

The blade 200 is withdrawn into the retracted position from an exposed position by applying a rearward-directed force (relative to the blade tip) to a slider 240 as depicted in FIG. 26. The slider is attached to the support member 204 and moves within a groove area 205. As the support member 204 is moved rearward, spring leafs 212A, 212B, 213A, and 213B of respective coils 212 and 213 are placed in a biased or cocked condition. A center region 212C and 213C of each respective coil 212 and 213 is fixed in location by action of respective fasteners 216 and 217 thereby permitting biasing of the spring leafs.

Figure 24:
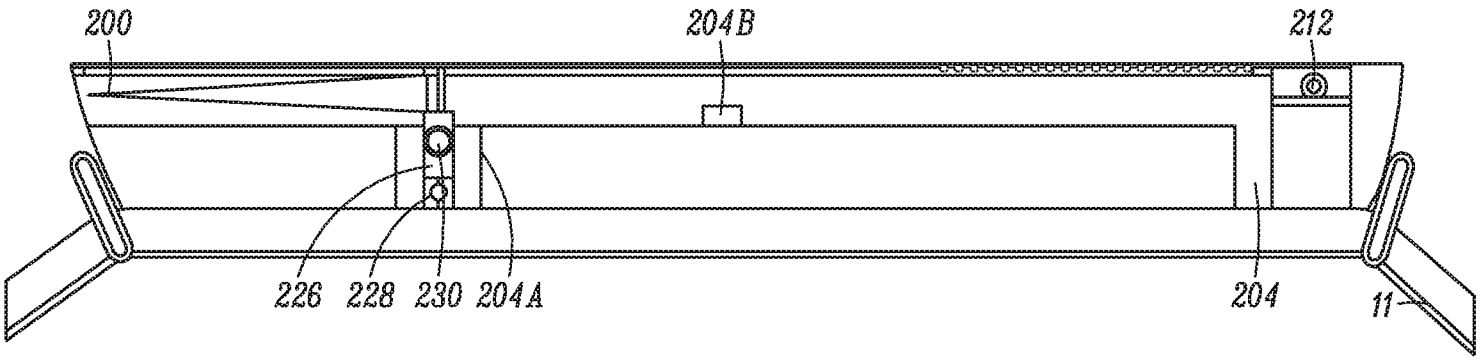
FIG. 24 illustrates a cut away view with a blade in a retracted position.

As can best be seen in FIG. 24, when the blade 200 is placed in the ready or cocked orientation, a blade lock bar 226 is urged upwardly by action of a spring 228 to contact a ledge 204A. The blade lock bar 226 retains the blade 200 in the cocked orientation.

Figure 28:
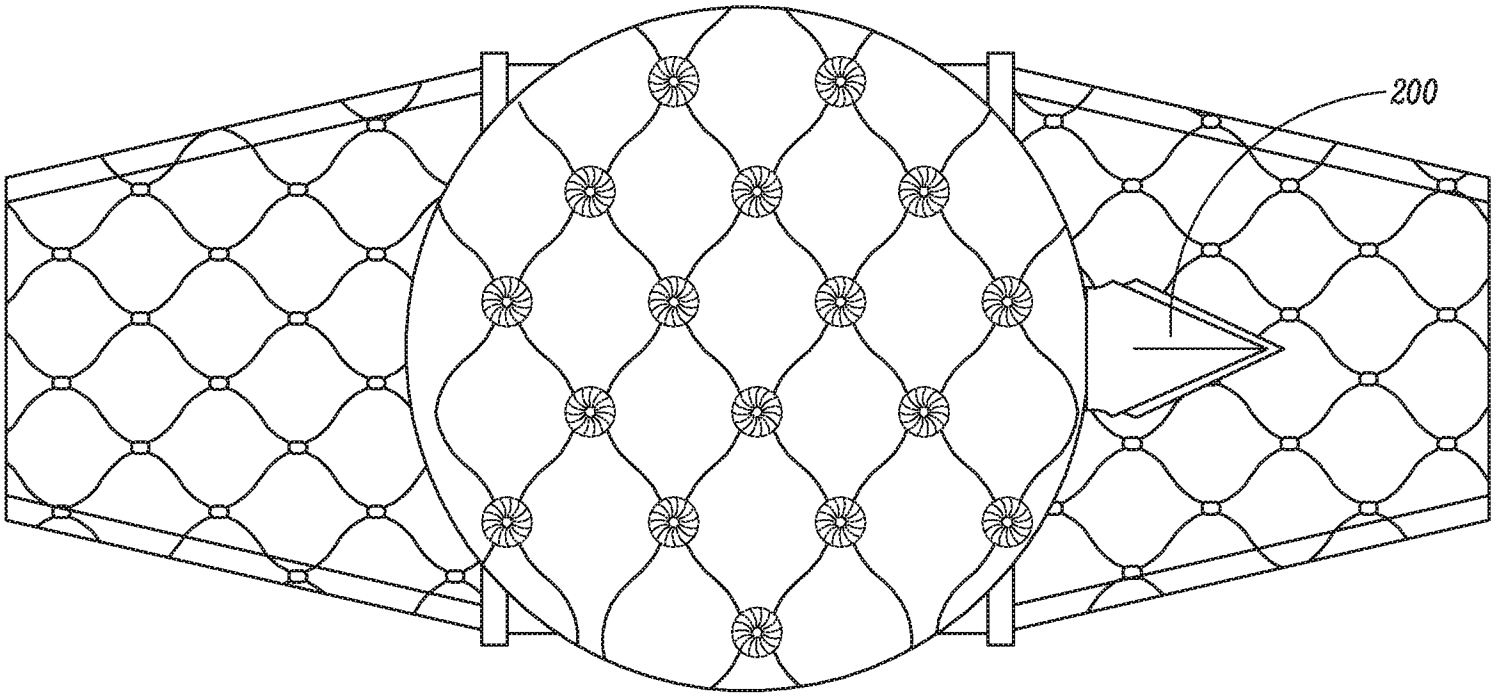
FIG. 28 illustrates the blade as deployed from a wearable item.

To eject the blade 200 from its concealed, retracted position, a downward directed force is applied to release pins 230 (see especially FIG. 22) extending outwardly from two sides of the blade compartment 201. This force moves the blade lock bar 226 downwardly and releases the blade 200. The potential energy stored within the coils 212 and 213, as depicted in FIG. 22, is released to drive the blade out of the blade compartment 201 and out of the ornamental item 10 as depicted in FIG. 28.

As the blade 200 travels outward from its concealed position, a notch 204B defined in the support member 204 also moves outward as depicted in FIG. 24. The blade lock bar 226, by action of the spring 228, slides into the notch 204B as it reaches the blade lock bar. This action stops outward travel of the blade 200 and holds the blade in this extended position. The blade 200 is now in position to be used against an attacker. To retract the blade the user must remove or loosen the ornamental item 10 from the wrist; lower the release pins 230 with a downward force, and while moving the slider 240 in the opposite direction of the blade tip, lock the blade in place behind the blade lock bar 226.

Figure 25:
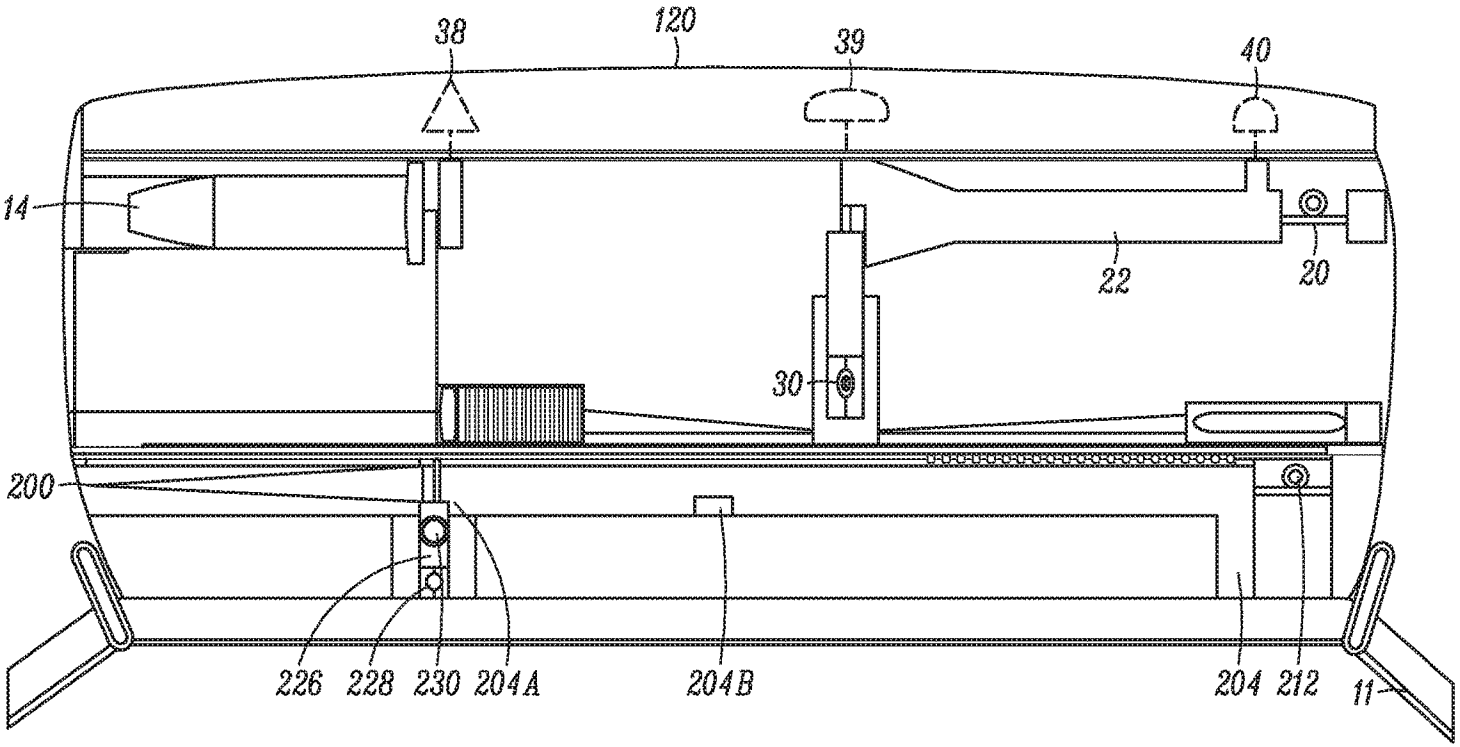
FIG. 25 illustrates a cut away view of an embodiment comprising both a blade and a firearm.

According to another embodiment depicted in FIG. 25, an ornamental item 10 includes both a firearm (housed in a firearm compartment) and a blade (housed in a blade compartment).

As illustrated in FIG. 25, the blade compartment (containing the blade-associated components as seen in FIG. 22) is disposed below the firearm compartment (containing the firearm-associated components as seen in FIG. 2) when the ornamental item 10 is worn by the user.

Figure 27:
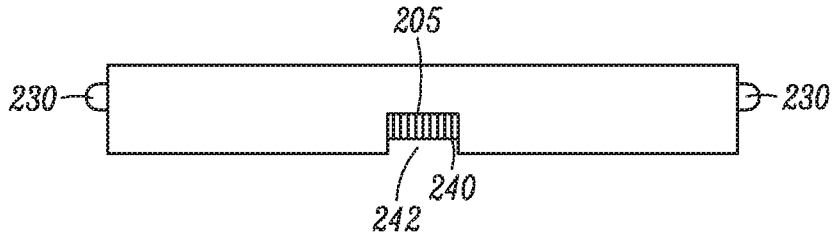

FIG. 26 is a bottom view of the embodiment of the blade compartment and FIG. 27 a rear view of the embodiment of the blade compartment. In this embodiment a blade compartment would be positioned closest to the wearer's skin and serves as the bottom of the ornamental item 10 and the firearm compartment is positioned above it as depicted in FIG. 25. A slider handle 240 for use in retracting the blade travels within a groove 242. The user must remove or loosen the ornamental item 10 to gain access to the slider handle 240. A loading zone cover 243A and 243B, when opened, reveals the barrels 90 and 91 each for receiving a bullet 16.

Figure 29:
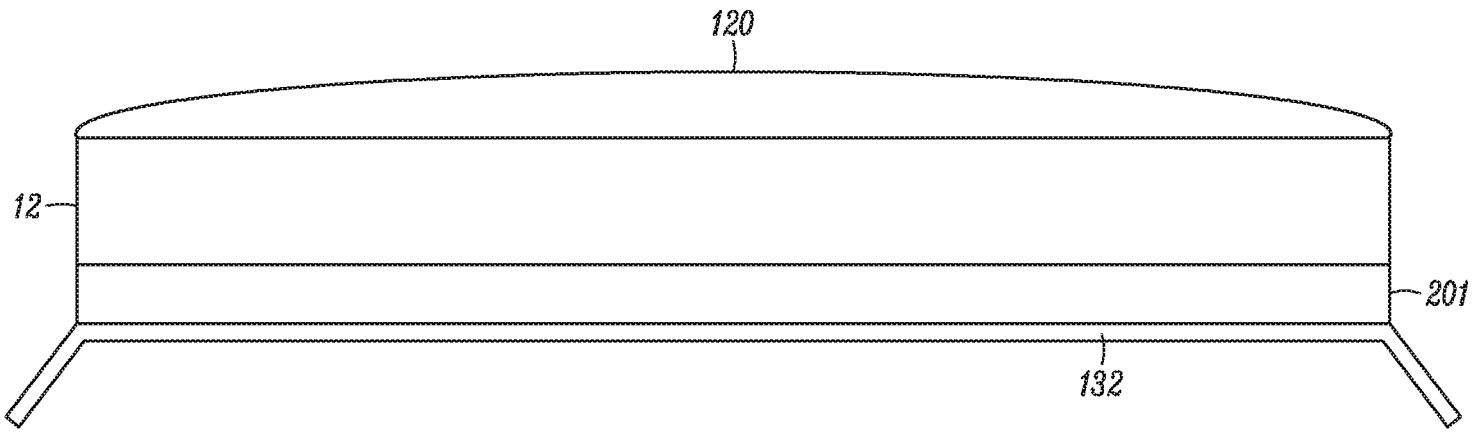
FIG. 29 illustrates a side view of the compartment layers of an embodiment of the present invention.

FIG. 29 depicts a simple view of the compartment layers of the embodiment of the ornamental item 10, which includes the safety cover 120 as depicted in FIG. 2, the firearm 12 as depicted in FIG. 2, the blade compartment 201 as depicted in FIG. 22 and the wrist band 132 as depicted in FIG. 15.

Although the invention has been shown and described with respect to a certain preferred embodiment or embodiments, equivalent alterations and modifications may occur to others skilled in the art upon the reading and understanding of this specification and the annexed drawings. In particular regard to the various functions performed by the above described components (assemblies, devices, circuits, etc.), the terms used to describe such components are intended to correspond, unless otherwise indicated, to any component that performs the specified function of the described component (i.e., that is functionally equivalent), even though not structurally equivalent to the disclosed structure, which performs the function in the herein illustrated exemplary embodiments of the invention. In addition, while a particular feature of the invention may have been disclosed with respect to only one of several embodiments, such feature may be combined with one or more other features of the other embodiments as may be desired and advantageous for any given or particular application.

What is claimed is:

1. A firearm disposed within an enclosure, the firearm comprising:

a barrel through which a bullet passes to exit the firearm;

a shell comprising a charge proximate a rear surface of the shell, the shell for receiving the bullet;

a firing pin moveable to a firing position by operation of a firing pin control;

a primer safety component a location of which relative to the charge is controlled by a primer safety handle, the primer safety component moveable from a safety position wherein the primer safety component is interposed between a rear surface of the shell and the firing pin, to a firing position exposing the rear surface of the shell;

a firing pin lock retaining the firing pin in the firing position when in a locked position;

a first biasing member for applying a force to the firing pin, movement of the firing pin restrained against the force by the locked position of the firing pin lock; and a trigger for releasing the firing pin lock from the locked position such that when the primer safety component is in the firing position, the force causes the firing pin to strike the rear surface of the shell, igniting the charge, thereby causing the bullet to be ejected from the barrel.

2. The firearm of claim 1 the enclosure attached to a wearable item.

3. The firearm of claim 2 the wearable item worn about a wrist or a neck of the user.

4. The firearm of claim 2 the wearable item comprising a wristwatch or a bracelet.

5. The enclosure comprising a first and a second firearm as in the firearm of claim 1.

6. The firearm of claim 1, the firing pin control comprising a firing pin slider slidable within a groove of the enclosure from a resting position to the locked position.

7. The firearm of claim 1 wherein the firing pin lock comprises a spring-driven component, in the locked position the spring-driven component contacting the firing pin and exerting a force on the firing pin to counter the force exerted by the first biasing member.

8. The firearm of claim 1 the enclosure comprising a cover when in an opened position revealing the primer safety handle, the firing pin control, and the trigger each for operation by a user and when in a closed position concealing the primer safety handle, the firing pin control, and the trigger.

9. The firearm of claim 1 further comprising a light for emitting a light beam in a direction that the bullet travels.

10. The firearm of claim 1 the first biasing member comprising a helical spring or a coil spring.

11. The firearm of claim 1 wherein the primer safety handle, the firing pin control, and the trigger all extend from a same surface of the enclosure for operation by the user.

12. The firearm of claim 1 further comprising a second biasing member, the first and second biasing members each applying a force to the firing pin.

* * * * *